US006411379B1

(12) United States Patent
von Sroka et al.

(10) Patent No.: US 6,411,379 B1
(45) Date of Patent: Jun. 25, 2002

(54) METHOD AND APPARATUS FOR THE LOCALIZATION OF ELEMENT CONCENTRATIONS IN A CONTINUOUS CASTING

(75) Inventors: Anwar von Sroka, Kettenkamp; Hartmut Oelmann, Osnabrück; Hubertus Brüning, Mettingen, all of (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 09/404,989

(22) Filed: Sep. 22, 1999

(30) Foreign Application Priority Data

Sep. 22, 1998 (DE) ..... 198 43 290

(51) Int. Cl.[7] ..... G01J 3/30
(52) U.S. Cl. ..... 356/313; 356/314; 356/36
(58) Field of Search ..... 356/36, 313, 314, 356/311

(56) References Cited

U.S. PATENT DOCUMENTS 4,692,875 A * 9/1987 Riley et al. ..... 364/497
4,783,471 A * 11/1988 Genna ..... 436/73
5,139,332 A * 8/1992 Kitaoka et al. ..... 356/313

FOREIGN PATENT DOCUMENTS

EP 0794 422 A2 * 3/1997 ..... G01N/1/28

* cited by examiner

*Primary Examiner*—Frank G. Font
*Assistant Examiner*—Layla Lauchman
(74) *Attorney, Agent, or Firm*—Kenyon & Kenyon

(57) ABSTRACT

In order to localize element concentrations in the edge areas of a horizontally manufactured continuous casting of alloyed non-ferrous metals, a longitudinal section is removed from the continuous casting. At least one strip of surface layer is then removed transversely by a metal removal unit from the longitudinal section forming a test specimen having a defined thickness. A point-by-point spectroanalysis of the metal composition is then carried out in linear sequence with the aid of a spectral-analysis head in the longitudinal direction of the strip. The element concentration determined in this manner is displayed numerically and/or graphically with the aid of a computer. The metal-removal unit and the spectral-analysis head are placed under the influence of a metal-removal and analysis control unit which is coupled to the computer via a programmable controller and via a spectrometer, respectively.

3 Claims, 3 Drawing Sheets

METHOD AND APPARATUS FOR THE LOCALIZATION OF ELEMENT CONCENTRATIONS IN A CONTINUOUS CASTING

BACKGROUND OF THE INVENTION

The invention relates to a method and apparatus regarding the localization of element concentrations in the edge areas of a horizontally manufactured continuous casting made of alloyed non-ferrous metals.

In the horizontal continuous casting of non-ferrous metal alloys, such as tin-bronze strips, and particularly those castings having a rectangular cross-section, there continue to be problems with respect to obtaining reliable information about the quality of the continuous castings, in spite of intense efforts in the field to overcome this deficiency. These difficulties mainly become evident when tin concentrations (tin segregations) are detected which exceed the alloy specification by some multiple. Such tin concentrations are anomalies which occur in the edge areas of the continuous casting over the entire length of the strip, extending mainly in the direction of casting, and as a rule are always present in a tin-bronze alloy. In practice, they are normally eliminated by removing a surface layer having a specific thickness, so that downstream, products of satisfactory quality can then be produced from such a continuous casting.

The thickness of the removed surface layer has heretofore been determined on the basis of values from experience which were sufficient for the normal case. However, under certain conditions during horizontal casting, tin concentrations are formed which extend beyond what is typical into the continuous casting at specific locations. The causes for this are usually intended or unintended changes in the cooling conditions. However, these anomalies only become evident in the form of bright yellow linear stripes on rolled and polished surfaces after several work operations have already been carried out. These lots are then generally scrapped.

SUMMARY OF THE INVENTION

The object of the present invention is to provide a method and apparatus for the localization of element concentrations in the edge areas of a horizontally manufactured continuous casting of alloyed non-ferrous metals, in which element concentrations can be reliably detected and eliminated in the event of changes to the cooling conditions present, whether intended or not, as well as regardless of an optionally implemented local homogenization cooling.

Accordingly, within the framework of the invention, a longitudinal section is removed as a test specimen from the continuous casting at the start and end of a coil to be wound, and a surface layer is removed from this test specimen in the transverse direction. The surface layer has a defined thickness and is in the form of a strip. The surface layer can be removed by milling, grinding or another type of mechanical machining. It is important that no lubricating agents be added during removal. The removal takes place over the total length of the test specimen, and thus of the width of the continuous casting.

Subsequently, a point-by-point spectroanalysis of the metal composition is carried out in linear sequence on these exposed strips of the test specimen in its longitudinal direction. The element concentrations determined in this connection—the tin concentrations in the case of a tin-bronze strip—are then displayed numerically and graphically with the aid of a computer.

If in so doing, it is determined that an element concentration in excess of the specified upper limit exists at at least one location, an additional layer is then removed along the strip, the additional layer being distinctly thinner than the first layer. Thereupon, the spectroanalysis of the material composition is again carried out in the longitudinal direction of the strip and the result is displayed. If the element concentration now remains below the limiting value, the continuous casting is released for the production of finished products or for further processing. If unacceptable anomalies are still present, a thin layer is again removed, a further spectroanalysis is then carried out, and after that a decision is made as to whether the continuous casting can be sent on for further processing.

Therefore, the method according to the invention permits precise determination of how much material must be removed from the continuous casting, so that an acceptable starting material can be made available for further processing.

This device has a sensor determining the position of the test specimen, a metal-removal unit and a spectral-analysis head which are displaceable relative to the test specimen and are placed under the influence of a metal-removal and analysis control unit that is coupled to a computer via a programmable controller and via a spectrometer, respectively. The computer has a monitor and a printer.

The test specimen removed from the continuous casting is fixed in place. The sensor then scans the surface of the test specimen and adjusts the metal-removal unit, in particular a milling head with milling cutter, in such a way that it can be used to remove a surface layer of uniform thickness. At the same time, the extension in the transverse direction is determined. The sensor is under the influence of a metal-removal and analysis control unit which is coupled to a programmable controller. The controller is in turn connected to a computer which positions the sensor stepwise via the controller and the metal-removal and analysis control unit, and in addition monitors all safety chains and functions of the device.

A predetermined layer thickness, 0.6 mm for example, is subsequently removed by the metal-removal unit in the WE form of a strip, resulting in a clean surface. The spectral-analysis head is run over this strip determining the metal composition point by point in linear sequence, the spectrometer also transmitting the concentration to the computer.

Since the computer collects all positioning and analysis data and also corrects the analysis data with reference to the calibration values, the analysis and positioning data are transferred into a diagram which is then displayed online on the computer's monitor. Here, it can be clearly discerned where an anomaly that may exceed the limiting values is present. If the computer detects such an anomaly, it immediately orders the metal-removal unit to remove an additional layer from the longitudinal section, this time, however, of a lesser thickness such as 0.2 mm. This may be carried out over the entire extension in the transverse direction of the longitudinal section, or only where the excess concentration was previously determined.

After removal of the second layer, a spectroanalysis is undertaken once more and it is determined whether the elevated concentration is still present or whether the element concentrations are within the limiting values. If they are within the limiting values, the anomaly is defined as acceptable, so that the values are then also defined for the machining of the continuous casting. If the anomaly is still present, an additional thin layer of 0.2 mm, for example, is removed and the test specimen is subsequently subjected to spectroanalysis.

In a further development of the idea according to the invention, it is advantageous for the metal-removal and analysis control unit to be connected to the spectrometer via an optical waveguide.

BRIEF DESCRIPTION OF THE DRAWINGS

Following, the invention is explained in greater detail with reference to the exemplary embodiments shown in the drawing, in which.

DETAILED DESCRIPTION OF THE INVENTION

Figure 1:
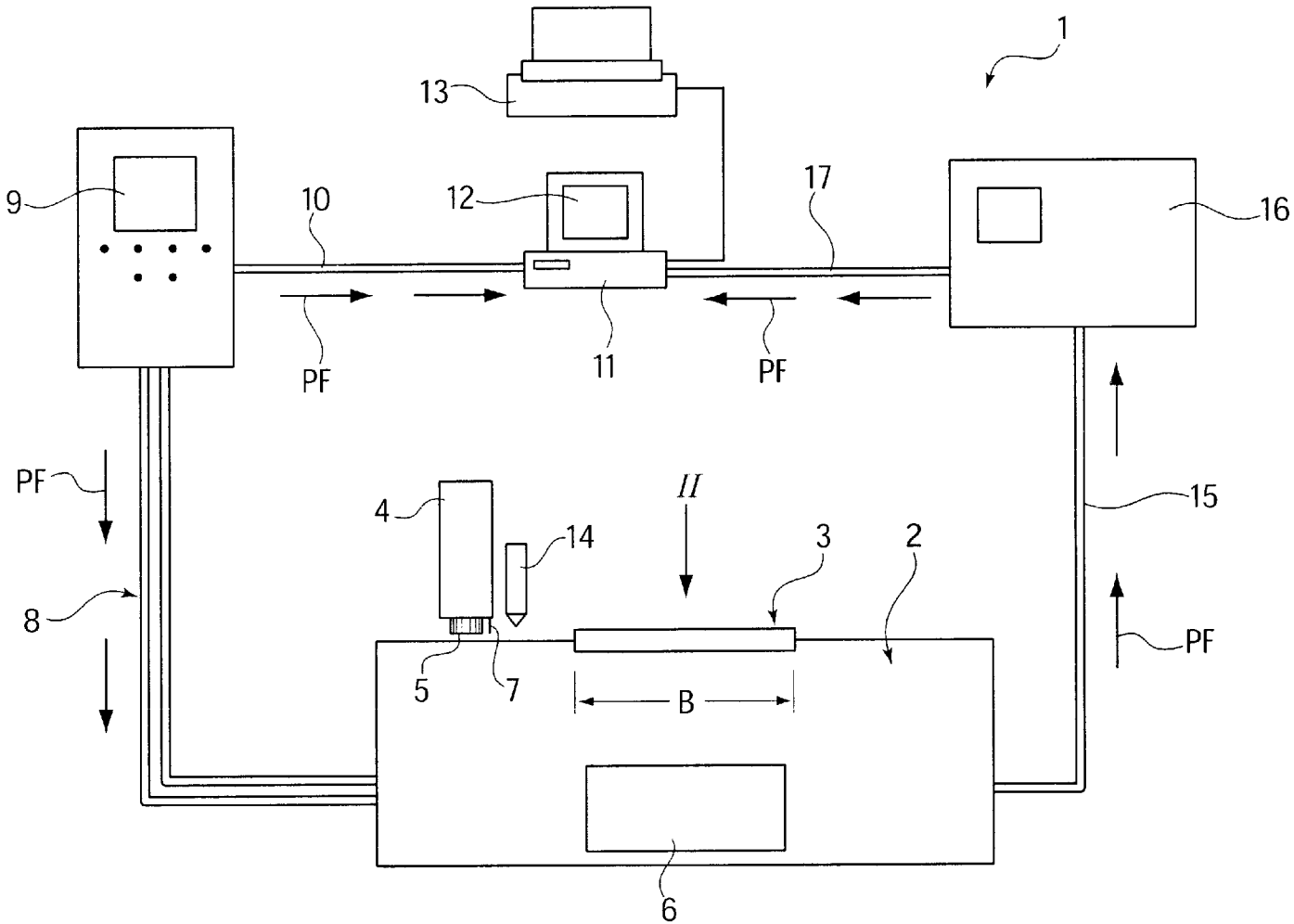
FIG. 1 shows a diagrammatic representation of a device for the localization of element concentrations in a continuous casting.
Figure 2:
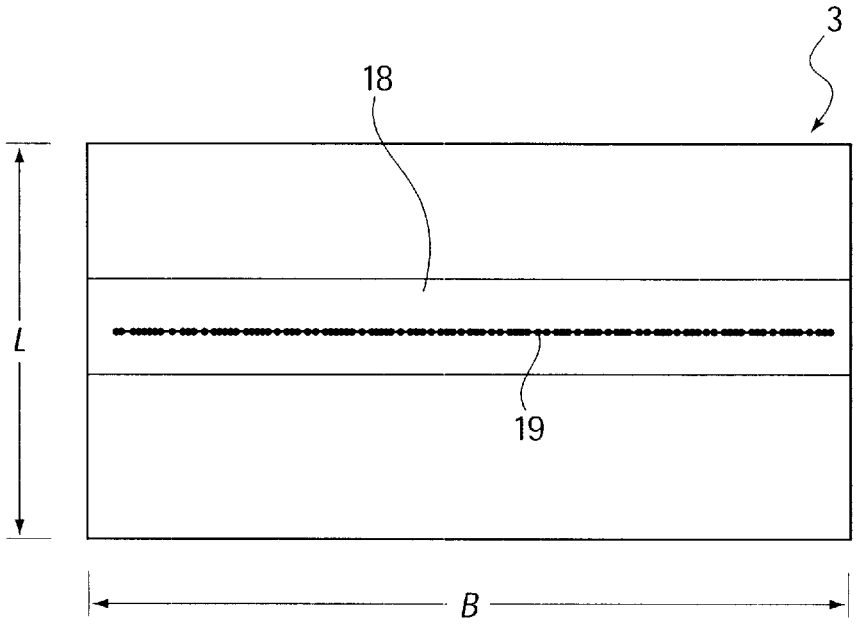
FIG. 2 shows an enlarged top view of a longitudinal section of a continuous casting forming a test specimen.

In FIG. 1, numeral 1 designates an arrangement for localizing element concentrations in the edge areas of a horizontally manufactured continuous casting made from a copper-tin alloy (CuSn4) and having a rectangular cross-section. Arrangement 1 includes a specimen table 2 on which a short longitudinal section of the continuous casting in the form of a test specimen 3 can be fixed in place. As FIG. 2 also makes evident in this connection, the length L of test specimen 3 removed from the continuous casting is clearly dimensioned to be smaller than the width B, which at the same time corresponds to the width of the continuous casting. With the width extension, test specimen 3 is also fixed in place in the longitudinal direction of specimen table 2.

A metal-removal unit 4 in the form of a milling head with milling cutter 5 is displaceable in the longitudinal direction of specimen table 2, and thus also parallel to the transverse direction of test specimen 3. Milling cutter 5 can be extended downwards out of metal-removal unit 4. In addition, metal-removal unit 4 can be displaced transversely with respect to specimen table 2. Moreover, metal-removal unit 4, in a manner not illustrated in greater detail, is under the influence of a metal-removal and analysis control unit 6 integrated into specimen table 2.

Allocated to metal-removal unit 4 is a sensor 7 which is used to ascertain the position of test specimen 3 on specimen table 2 and its width extension B in the transverse direction.

Since metal-removal unit 4 is under the influence of metal-removal and analysis control unit 6, it is also coupled via a cable 8 to a programmable controller 9 that in turn is coupled via a cable 10 to a computer 11 having a monitor 12 and a printer 13.

Furthermore, a spectral-analysis head 14 is displaceable in the longitudinal direction of specimen table 2, and thus parallel to width extension B of test specimen 3.

Spectral-analysis head 14 is also under the influence of metal-removal and analysis control unit 6 which, for its part, is coupled via optical waveguide 15 to a spectrometer 16 that in turn is coupled to computer 11 via a cable 17.

To carry out an analysis, sensor 7 is first moved over test specimen 3 via controller 9 and control unit 6, the sensor scanning the position and width B of the test specimen. Controller 9, using the values signaled to it, then adjusts metal-removal unit 4 in such a way that mill cutter 5 mills off a surface layer in the form of a strip with a depth of 0.6 mm from test specimen 3 in width extension B (see also FIG. 2).

Subsequent to that, spectral-analysis head 14 is moved in the longitudinal direction of milled strip 18 by computer 11 via controller 9, a point-by-point spectroanalysis of the metal composition of test specimen 3 being carried out in linear sequence 19 (arc spots of the spectrometer). In doing so, spectrometer 16 receives instructions from computer 11 as to which alloy is to be analyzed and when to spark. Spectrometer 16 determines the composition by emission spectrometry and signals the concentration to computer 11.

In this connection, arrows PF identify the flow of information.

Computer 11 collects the positioning data and analysis data and makes any necessary corrections with reference to the calibration values. It then transfers the analysis and positioning data to a diagram which, according to FIG. 3, is displayed online on monitor 12.

Width B of test specimen 3 is shown in millimeters on abscissa A and the tin concentration is shown in percentages on ordinate O. The acceptable tin concentration ranges between approximately 3.5 to 4.5 percent.

Figure 3:
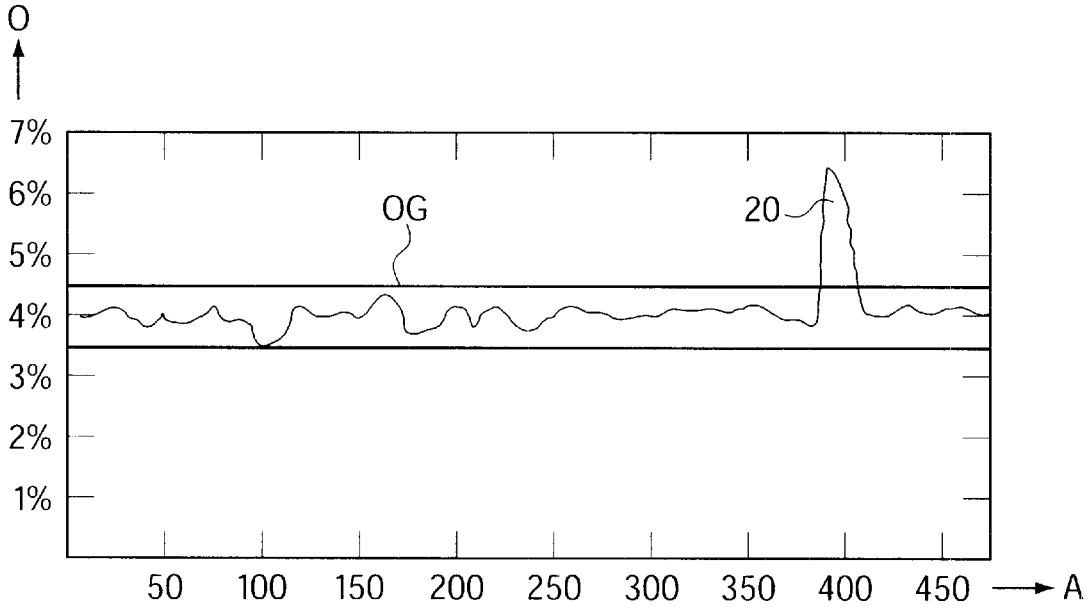
FIGS. 3 to 6 show various diagrams of a segregation analysis.

In the exemplary embodiment, at a milling depth of approximately 0.6 mm, spectrometer 16 has detected a tin concentration 20 exceeding the upper limit OG from position 375 to 425 mm, transmitted it to computer 11 and displayed it according to FIG. 3.

Metal-removal unit 4 is moved once again in the longitudinal direction of strip 18, an additional 0.2 mm of material being removed.

Thereupon, spectral-analysis head 14 is moved in the longitudinal direction of strip 18 and the metal composition is determined.

Figure 4:
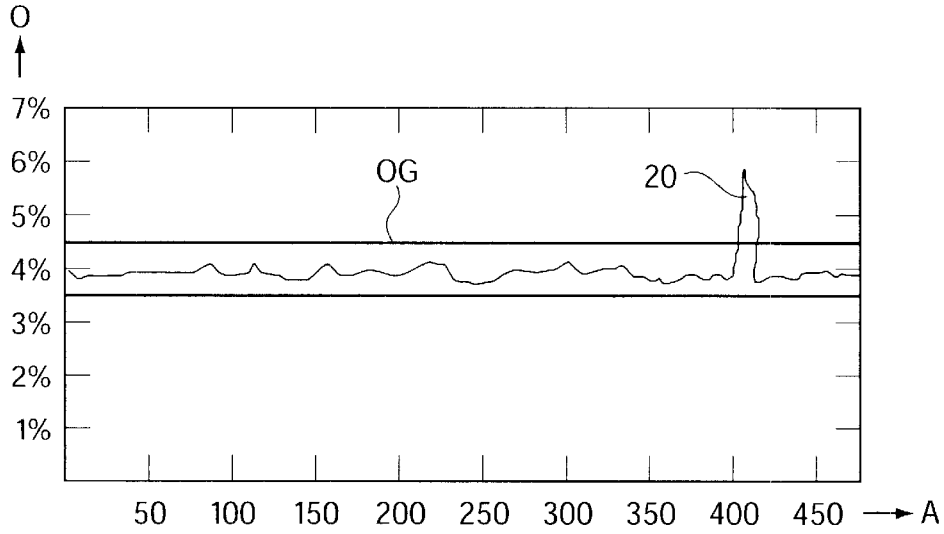

As can be recognized in this connection from FIG. 4, at a total milling depth now of 0.8 mm, this analysis also still shows an elevated tin concentration 20 in the area between 375 and 425 mm. However, it can also be seen that tin concentration 20 has become narrower at the base.

Based on the still elevated tin concentration 20, metal-removal unit 4 is then moved once again in the longitudinal direction of strip 18, and an additional layer of 0.2 mm is removed.

Thereupon, spectral-analysis head 14 is moved again in the longitudinal direction of strip 18 and the existing metal composition is determined.

Figure 5:
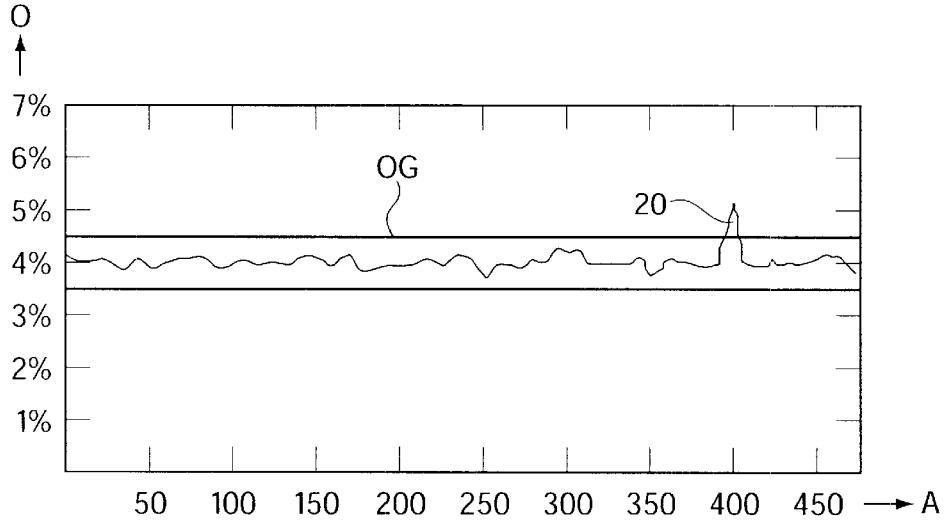

As FIG. 5 shows, given the existing milling depth totaling roughly 1 mm, an elevated tin concentration 20 is still present between position 375 and 425 mm.

However, FIG. 5 shows that tin concentration 20 has become markedly narrower at the base.

Thereupon, metal-removal unit 4 is again moved in the longitudinal direction of strip 18 and an additional layer having a thickness of 0.2 mm is removed by milling cutter 5.

Spectral-analysis head 14 is then moved in the longitudinal direction of strip 18 and the metal composition is determined.

Figure 6:
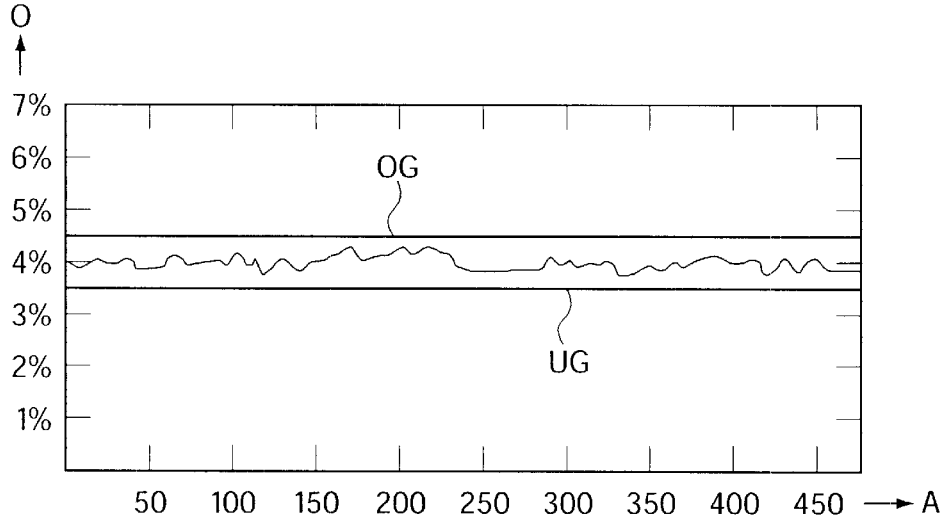

As is now evident from the diagram according to FIG. 6 displayed on monitor 12 of computer 11, no increased concentration or anomaly is discernible any longer at a total milling depth of 1.2 mm. The concentration curve of the tin ranges between the two limit lines OG and UG.

From this test result, it thus follows that the milling cutter for machining the continuous casting must be set to a milling depth of 1.4 mm to ensure that the continuous casting (metal strip) wound into a coil contains no unacceptably high tin concentrations which could lead to a rejection of the respective products during subsequent processing of the continuous casting.

What is claimed is:

1. A method for the localization of element concentrations in the edge areas of a horizontally manufactured continuous casting of alloyed non-ferrous metals, comprising the steps of:

removing a longitudinal section from a continuous casting for use as a test specimen;

removing at least one transverse strip of surface layer from the longitudinal section, the transverse strip having a defined thickness;

performing a point-by-point spectroanalysis of the metal composition of the strip in linear sequence in the longitudinal direction of the strip to determine element concentrations; and displaying the element concentrations as numbers and/or graphically with the aid of a computer.

2. An apparatus for determining the localization of element concentrations in a test strip, comprising:

a sensor for determining the position of a test specimen;

a metal-removal unit;

a spectral-analysis head;

a spectrometer; and a control unit;

wherein the metal-removal unit and spectral-analysis head are displaceable relative to the test specimen and are placed under the control of the metal-removal and analysis control unit that is coupled to the computer via the programmable controller and via the spectrometer, respectively.

3. The apparatus as set forth in claim 2, in which the metal-removal and analysis control unit is connected to the spectrometer via an optical waveguide.

* * * * *

UNITED STATES PATENT AND TRADEMARK OFFICE

CERTIFICATE OF CORRECTION

PATENT NO. : 6,411,379 B1
DATED : June 25, 2002
INVENTOR(S) : Anwar Von Sroka et al.

It is certified that error appears in the above-identified patent and that said Letters Patent is hereby corrected as shown below:

Column 2,
Line 41, change "in the WE form of a" to -- in the form of a --.

Signed and Sealed this

Twenty-fifth Day of March, 2003

JAMES E. ROGAN
*Director of the United States Patent and Trademark Office*